US006935114B2

(12) United States Patent
Hajek et al.

(10) Patent No.: US 6,935,114 B2
(45) Date of Patent: Aug. 30, 2005

(54) SYSTEM AND METHOD FOR STARTING AN ENGINE

(75) Inventors: Thomas J. Hajek, Lockport, IL (US); David P. Smith, Joliet, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/303,166

(22) Filed: Nov. 25, 2002

(65) Prior Publication Data

US 2003/0121265 A1 Jul. 3, 2003

Related U.S. Application Data

(60) Provisional application No. 60/342,849, filed on Dec. 28, 2001.

(51) Int. Cl.[7] ..... F02N 9/00
(52) U.S. Cl. ..... 60/629
(58) Field of Search ..... 60/629, 597, 413, 60/625, 626, 627, 628

(56) References Cited

U.S. PATENT DOCUMENTS 3,861,144 A * 1/1975 Woods ..... 60/386
3,999,531 A * 12/1976 Taylor ..... 123/196 M
4,541,243 A * 9/1985 Clark ..... 60/595
4,741,410 A * 5/1988 Tunmore ..... 180/165
5,167,292 A * 12/1992 Moiroux et al. ..... 180/165
5,179,921 A * 1/1993 Figliuzzi ..... 123/198 C
6,206,656 B1 3/2001 Bailey et al.
6,484,674 B2 * 11/2002 Valentin ..... 123/46 R

* cited by examiner

*Primary Examiner*—Hoang Nguyen
(74) *Attorney, Agent, or Firm*—Finnegan, Henderson, Farabow, Garrett & Dunner; D. James Barnes

(57) ABSTRACT

A system and method for starting an engine having a crankshaft is provided. Pressurized fluid is stored in an accumulator. A flow of pressurized fluid is released from the accumulator. The flow of pressurized fluid released from the accumulator is directed to a pump that is operatively engaged with the crankshaft of the engine. The flow of pressurized fluid drives the pump to generate a rotation of the crankshaft and thereby start the engine.

22 Claims, 4 Drawing Sheets

SYSTEM AND METHOD FOR STARTING AN ENGINE

RELATED APPLICATIONS

This application claims the benefit of U.S. Provisional Patent Application 60/342,849, filed on Dec. 28, 2001, which is expressly incorporated herein.

TECHNICAL FIELD

The present invention is directed to a system and method for starting an engine. More particularly, the present invention is directed to a system and method for using pressurized fluid to start an engine.

BACKGROUND

Energy efficiency is one factor that is considered when designing a vehicle, such as a work machine. To improve efficiency, vehicles may be equipped with devices that capture and regenerate energy that would otherwise be wasted during the standard operation of the vehicle. In the case of a work machine, which may be, for example, a wheel loader, a track loader, a backhoe, an excavator, a bulldozer, or another earth moving machine, a device such as an accumulator may be included to capture and regenerate energy in the form of pressurized fluid. For example, the potential energy of an elevated work implement may be captured by directing pressurized fluid that is released from a hydraulic actuator to the accumulator instead of directing the fluid to a tank. The stored pressurized fluid in the accumulator may be used to assist the work machine in a later operation, whereas the energy of the fluid directed to tank would be dissipated. By storing and reusing energy in this manner, the overall efficiency of the work machine may be improved.

Many vehicles utilize internal combustion engines to generate the power required to operate the vehicle. The power generated by the engine may be used to move the vehicle along a desired path. The engine may also provide power for additional functions of the vehicle. For example, in a work machine, the engine may be used to drive a pump and generate the pressurized fluid needed to move a work implement through a work cycle.

One possible use of pressurized fluid stored in an accumulator is to assist in the starting of an internal combustion engine. Typically, a vehicle that has an internal combustion engine also includes a battery that is connected to a starter motor. To start the vehicle, the operator turns a key or depresses a start button, which causes the battery to apply a voltage to the starter motor. The applied voltage energizes the starter motor, which may then rotate a crankshaft of the engine to start moving the pistons and thereby start the engine. However, the starter motors are often subject to heavy use and may require periodic maintenance. This periodic maintenance may result in down time for the work machine. In addition, the failure of a starter motor may result in additional down time for the work machine. Thus, maintenance or failure of a starter motor may result in decreased efficiency of the work machine.

As discussed in U.S. Pat. No. 6,206,656, stored, pressurized fluid may be used to assist in the starting of an internal combustion engine. This may be accomplished by directing the pressurized fluid against each piston in an internal combustion engine to move the pistons and thereby start the engine. However, this type of system will require a complex network of valves and fluid lines to provide pressurized fluid to each piston in the engine, as well as to ensure that the delivery of pressurized fluid is timed to help assist the movement of the pistons instead of opposing movement of the pistons.

The system of the present invention solves one or more of the problems set forth above in efficiently starting an engine.

SUMMARY OF THE INVENTION

One aspect of the present invention is directed to a method of starting an engine having a crankshaft. Pressurized fluid is stored in an accumulator. A flow of pressurized fluid is released from the accumulator. The flow of pressurized fluid released from the accumulator is directed to a pump that is operatively engaged with the crankshaft of the engine. The flow of pressurized fluid drives the pump to generate a rotation of the crankshaft and thereby start the engine.

In another aspect, the present invention is directed to a hydraulic circuit for starting an engine. A pump having a drive gear is operatively engaged with the engine. An accumulator is in fluid communication with the pump and is configured to store a supply of pressurized fluid. A valve is configured to selectively allow a flow of pressurized fluid from the accumulator to the pump. A control is configured to selectively open the valve to allow the flow of pressurized fluid to the pump to drive the pump and thereby start the engine.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate exemplary embodiments of the invention and together with the description, serve to explain the principles of the invention. In the drawings.

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
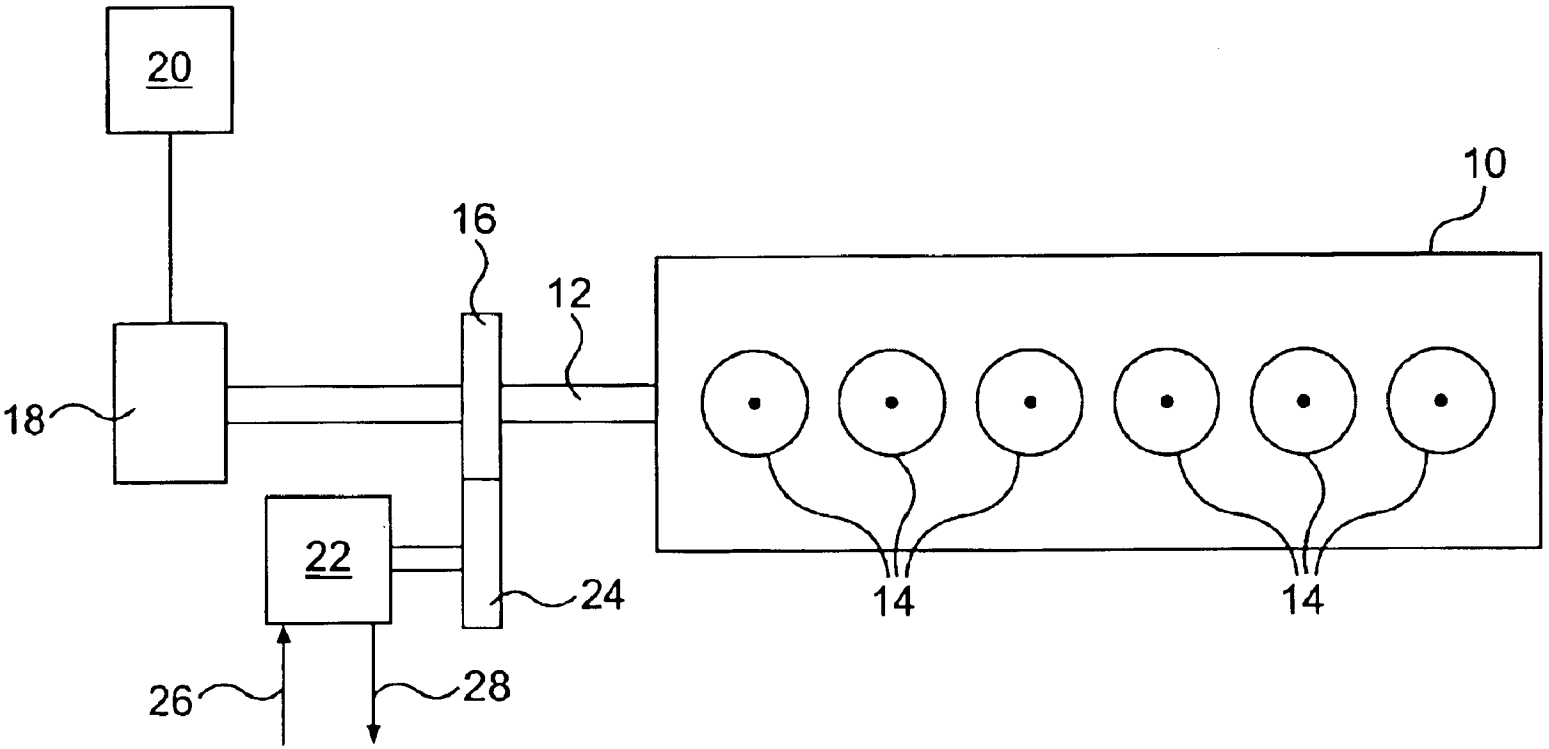
FIG. 1 is a schematic and diagrammatic illustration of a system for starting an internal combustion engine.

An engine 10 is diagrammatically and schematically illustrated in FIG. 1. Engine 10 may be an internal combustion engine, such as, for example, an engine operating on the diesel cycle. Engine 10 may also be a natural gas engine or a gasoline engine.

As shown, engine 10 includes a crankshaft 12 that is mounted for rotating movement within an engine block.

Crankshaft 12 is operatively connected to a series of pistons 14 that are disposed for reciprocating movement within a series of chambers in the engine block. A rotation of crankshaft 12 will cause pistons 14 to reciprocate within the chambers.

When engine 10 is in operation, a fuel system (not shown) provides fuel, such as, for example, diesel fuel, natural gas, or gasoline, to the chambers. The fuel is combusted within the chambers, thereby exerting a force on pistons 14. The force created by the fuel combustion drives pistons 14 in a manner that creates a rotation of crankshaft 12. Thus, when crankshaft 12 is rotating, engine 10 will continue to operate as long as fuel is supplied to the chambers and, in the case of diesel engines, compression causes ignition of the fuel mixture.

As shown in FIG. 1, a flywheel 16 may be secured to crankshaft 12. A rotation of crankshaft 12 will result in a corresponding rotation of flywheel 16. Similarly, a rotation of flywheel 16 will result in a corresponding rotation of crankshaft 12.

As also shown in FIG. 1, a pump/motor (hereinafter pump) 22 may be connected to crankshaft 12. Pump 22 may be directly or indirectly connected to crankshaft 12 through any mechanical or hydraulic coupling readily apparent to one skilled in the art. For example, pump 22 may include a drive gear 24 that is operatively engaged with flywheel 16. When connected in this manner, a rotation of flywheel 16 causes a corresponding rotation of drive gear 24.

Pump 22 may be configured such that when pressurized fluid is directed to the pump inlet, pump 22 may generate a rotation of drive gear 24. Pump 22 may, for example, include a cylinder barrel, a plurality of reciprocating pistons, and a swashplate, which transform the fluid pressure into a mechanical rotation of drive gear 24.

When engine 10 rotates drive gear 24, pump 22 generates a flow of pressurized fluid. When drive gear 24 is rotating, pump 22 draws a flow of fluid through a fluid inlet line 26. Pump 22 works the fluid to a predetermined pressure and directs the flow of pressurized fluid through a fluid outlet line 28.

The schematic illustration of FIG. 1 includes a exemplary embodiment of a conventional start system for invoking operation of engine 10. The conventional start system may include a battery 20 and a starter motor 18 that is operatively connected to crankshaft 12. When an operator issues an ignition command to start engine 10, such as, for example, by turning a key or by depressing a button, battery 20 applies a voltage to starter motor 18. The applied voltage causes starter motor 18 to rotate crankshaft 12. The induced rotation of crankshaft 12 may start engine 10.

Figure 2:
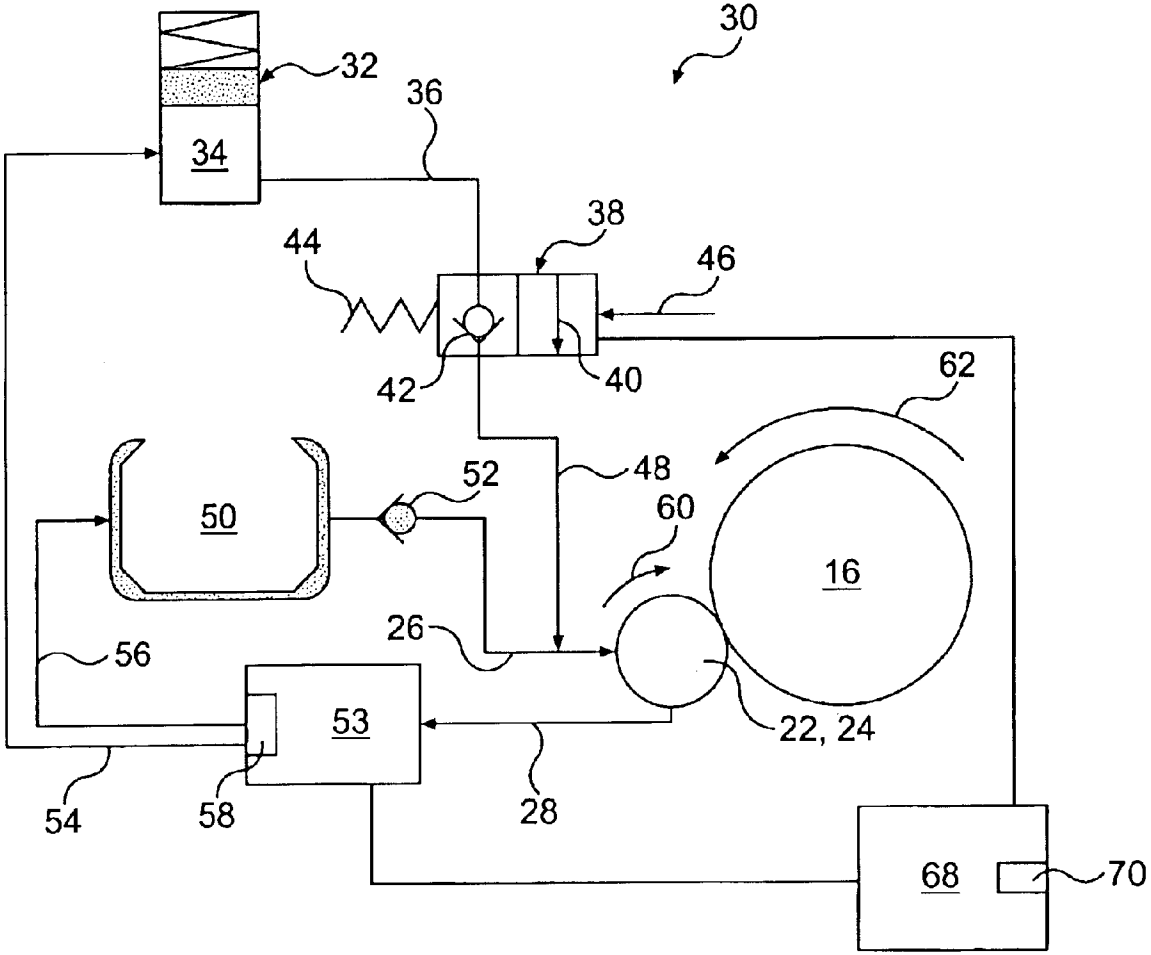
FIG. 2 is a schematic and diagrammatic illustration of a system for starting an internal combustion engine in accordance with one exemplary embodiment of the present invention.
Figure 3:
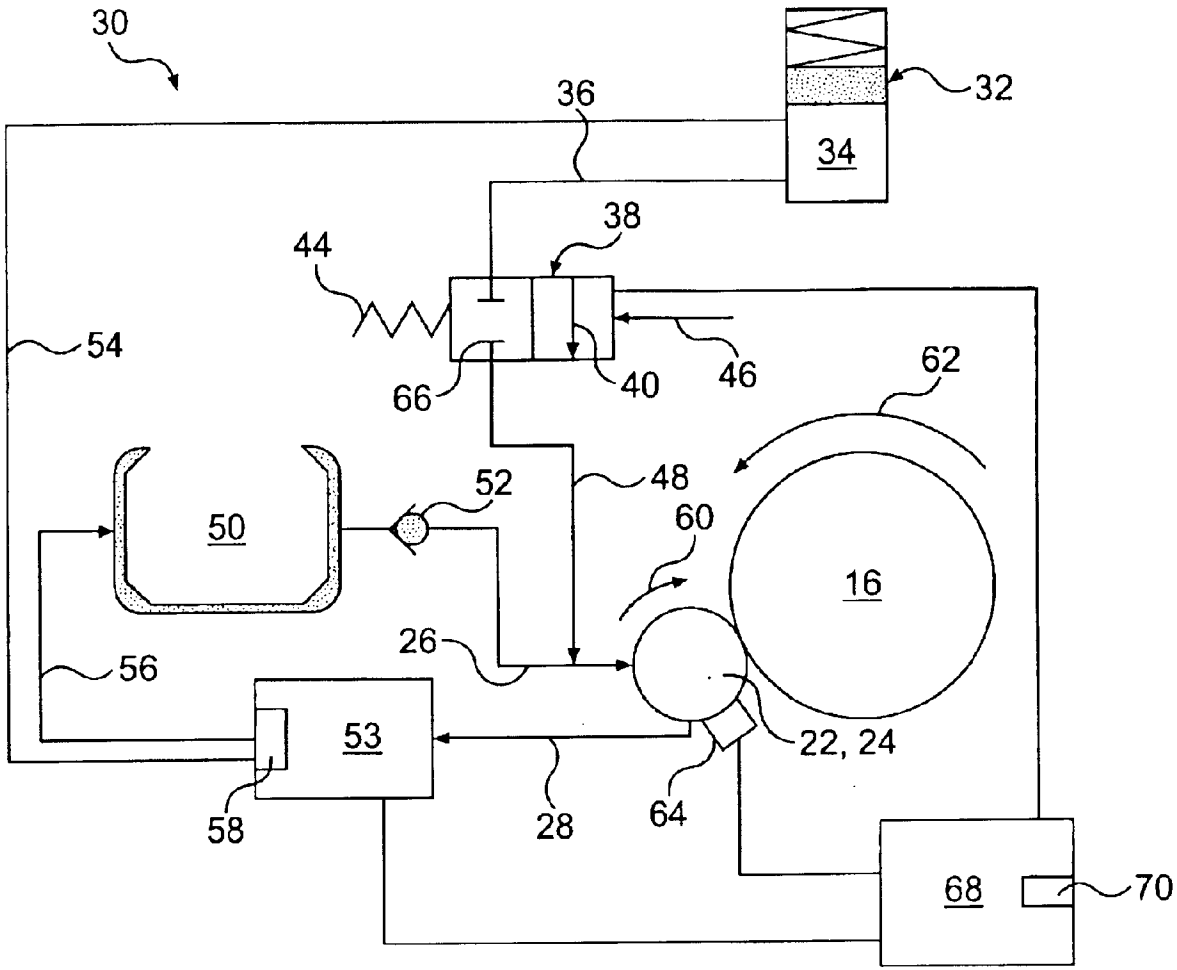
FIG. 3 is a schematic and diagrammatic illustration of a system for starting an internal combustion engine in accordance with another exemplary embodiment of the present invention.

FIGS. 2 and 3 diagrammatically and schematically illustrate exemplary embodiments of a start system 30 for starting engine 10 in accordance with the present invention. As shown, start system 30 includes an accumulator 32. Accumulator 32 includes a chamber 34 and is configured to store a supply of pressurized fluid. The pressurized fluid stored in accumulator 32 may be released through a fluid line 36.

A valve 38 may be disposed between fluid line 36 and a fluid line 48. Valve 38 is configured to regulate the flow of fluid released from accumulator 32. Valve 38 may be opened to allow fluid to flow from accumulator 32 into fluid line 48. Valve 38 may be closed to stop or prevent fluid from flowing into fluid line 48. Valve 38 may be configured to allow a variable flow rate of fluid or may be configured to allow a predetermined flow rate of fluid.

Valve 38 may be any device readily apparent to one skilled in the art as capable of regulating the flow of fluid from accumulator 32. For example, as shown in FIG. 2, valve 38 may include an open passage 40 and a check valve 42. A spring 44 may act on valve 38 to move valve 38 so that check valve 42 is aligned with fluid line 36. Check valve 42 will prevent fluid from flowing into fluid line 48. To open valve 38, a force 46 may be applied to valve 38. Force 46 moves open passage 40 into alignment with fluid line 36. In this position, fluid may flow through valve 38 and into fluid line 48.

Alternatively, as illustrated in FIG. 3, valve 38 may be a spool valve. It should be understood that valve 38 may be any other type of valve configured to regulate a flow of fluid, such as, for example, an independent metering valve. Valve 38 may be biased into a closed position by spring 44. Force 46 may be applied to valve 38 to open valve 38. The magnitude of force 46 may dictate the amount of fluid allowed to flow through valve 38. For example, a greater force may cause a greater flow rate of fluid to flow through valve 38 than a smaller force.

A control 68 may be provided to govern the position of valve 38. Control 68 may include a computer, which has all the components required to run an application, such as, for example, a memory 70, a secondary storage device, a processor, such as a central processing unit, and an input device. One skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as computer chips and secondary storage devices, including hard disks, floppy disks, CD-ROM, or other forms of RAM or ROM.

Control 68 may send a signal to valve 38 to control the amount of fluid flowing from accumulator 32. The signal may be, for example, a voltage or current that is variable in magnitude to govern the force 46 that modulates valve 38. Alternatively, the signal may be a pulse width modulation type signal. By varying the signal, control 68 may regulate the position of valve 38 and thereby control the amount of fluid released from accumulator 32.

As illustrated in FIGS. 2 and 3, when valve 38 is opened, pressurized fluid will flow from accumulator 32 through fluid line 48 and into pump 22 through fluid inlet line 26. A check valve 52 may be placed in fluid inlet line 26. When pump 22 is operating and acting to draw fluid from tank 50, check valve 52 may open to allow fluid to flow from tank 50 to pump 22. Check valve 52 may be configured to allow a maximum flow of fluid through fluid inlet line 26. Alternatively, check valve 52 may be configured to open into a "choke" position, where a restricted flow of fluid is allowed from tank 50 to pump 22. Check valve 52 may be configured to close when the pressure of the fluid in fluid inlet line 26 is greater than the pressure of the fluid in tank 50. Check valve 52 may be configured to move to a fully closed position, where no fluid is allowed to return to tank 50, or to a partially closed position, where the flow of fluid to tank 50 is restricted.

As will be recognized by one skilled in the art, an introduction of pressurized fluid into the inlet of pump 22 causes pump 22 to rotate drive gear 24 in addition to discharging pressurized fluid to fluid outlet line 28. Thus, the energy of the pressurized fluid stored in accumulator 32 may be used to drive pump 22 and cause a corresponding rotation of drive gear 24.

Pump 22 may be a fixed capacity pump or a variable capacity pump. In a fixed capacity pump, the introduction of pressurized fluid to fluid inlet line 26 will cause pump 22 to rotate drive gear 24. However, in a variable capacity pump, an activation device, such as a swash plate, is typically adjusted to provide pressurized fluid to fluid inlet line 26 to cause a selectively variable rotation of drive gear 24.

As illustrated in FIG. 3, control 68 may be connected to an activation device 64 on a variable capacity pump. Activation device 64 may be a solenoid activated swash plate. The position of swash plate may govern the flow rate of fluid produced by the pump. Accordingly, when fluid is supplied to the inlet of pump 22, control 68 may send a signal to activation device 64 to adjust the swash plate to the appropriate position. In this manner, pressurized fluid from accumulator 32 may be used to drive a variable capacity pump.

Control 68 may open valve 38 to generate a flow of pressurized fluid to pump 22 to start, or to assist in the starting of, engine 10 in response to a start signal, such as may be generated by the turning of an ignition switch or the depressing of a start button. As described above, the opening of valve 38 results in the introduction of pressurized fluid to fluid inlet line 26, which generates a rotation of drive gear 24. The rotation of drive gear 24 causes a corresponding rotation of flywheel 16 and crankshaft 12. For example, if drive gear 24 is rotated in the direction of arrow 60, flywheel 16 and crankshaft 12 will rotate in the direction of arrow 62.

The rotation of flywheel 16 and crankshaft 12 will cause pistons to reciprocate within their respective chambers. In the case of a diesel engine, where the fuel is ignited by compressing the fuel, the movement of pistons 14 within their chambers will compress the fuel and thereby initiate fuel combustion. The magnitude of the pressure exerted on the fuel in a chamber by the respective piston is governed by the torque exerted on crankshaft 12 by drive gear 24. If necessary, the torque exerted on crankshaft 12 may be increased by further opening valve 38 to allow a greater flow rate of pressurized fluid to flow from accumulator 32 to the inlet of pump 22. Similarly, the torque exerted on crankshaft 12 may be increased by adjusting valve 38 to reduce the flow rate of pressurized fluid flowing from accumulator 32 to the inlet of pump 22.

The rotation of flywheel 16 and crankshaft 12 may also initiate the auxiliary systems required to run the engine. For example, the rotation of crankshaft 12 may be used to urge the fuel system to supply fuel to the chambers. In addition, if necessary, the rotation of crankshaft 12 may be used to power a generator to charge battery 20 (referring to FIG. 1).

Start system 30 may invoke a rotation of crankshaft 12 to start engine 10. By opening valve 38, pressurized fluid may be directed to the inlet of pump 22 and thereby cause a rotation of crankshaft in a similar manner to the starter motor described in connection with FIG. 1. Thus, start system 30 may be used to replace or to supplement the starter motor.

After engine 10 has started, control 68 may close valve 38 to stop the flow of fluid from accumulator 32. Control 68 may close valve 38 after a predetermined period of time or after the start of engine 10 is otherwise sensed. Control 68 may send a signal to cause the release of force 46 to allow spring 44 to bias valve 38 to the closed position.

As illustrated in FIGS. 2 and 3, fluid exiting pump 22 may be directed through fluid exit line 28 to a hydraulic system 53. Hydraulic system 53 may also include a directional control valve 58 that is configured to control the rate and direction of fluid flow to accumulator 32 and to tank 50. During the starting process of engine 10, the fluid exiting pump 22 will be of a relatively low pressure as the energy of the fluid is used to drive pump 22. This relatively low pressure fluid will be directed through fluid outlet line 28 to hydraulic system 53. Directional control valve 58 may direct this relatively low pressure fluid into fluid line 56 and to tank 50.

After engine 10 has been started and valve 38 closed, crankshaft 12 drives pump 22 and, in turn, pump 22 draws fluid from tank 50 through check valve 52, working the fluid to a predetermined pressure. Hydraulic system 53 may include a series of directional control valves and a series of hydraulic actuators. The directional control valves may be selectively opened to direct the pressurized fluid exiting pump 22 to the hydraulic actuators to thereby move the hydraulic actuators. The movement of the hydraulic actuators may be controlled to thereby control the movement of a corresponding work implement. The pressurized fluid exiting pump 22 may also be directed to a fluid motor and used to propel the work machine.

Hydraulic system 53 may also direct a portion of the pressurized fluid produced by pump 22 to accumulator 32. This pressurized fluid can replace the fluid spent during the starting process of engine 10 and refill the accumulator 32. Thus, the accumulator 32 will contain sufficient pressurized fluid to start the engine in the future.

Accumulator 32 may also be re-filled by capturing pressurized energy released from one or more of the hydraulic actuators that would otherwise be directed to tank 50. As will be recognized by one skilled in the art, under certain circumstances, such as when a work implement is released from an elevated position, the fluid released from the corresponding hydraulic actuators may be pressurized. In these circumstances, directional control valve 58 may direct this pressurized fluid to accumulator 32, instead of tank 50. In this manner, energy that would otherwise be dissipated as heat may be reclaimed as pressurized fluid and used to start the engine at a later time.

The pressurized fluid stored in accumulator 32 may also be used to supplement the pressurized fluid production of pump 22 and assist in moving the hydraulic actuators of hydraulic system 53. Considering, for example, a wheel loader that includes a first hydraulic actuator for lifting a work implement and a second hydraulic actuator that may tilt the work implement. Upon appropriate commands from an operator, pressurized fluid may be directed from accumulator 32 to the second hydraulic actuator to tilt the work implement while the pump supplies pressurized fluid to the first hydraulic actuator to lift the work implement. One skilled in the art will recognize that the pressurized fluid stored in accumulator 32 may also be used for many other purposes.

Figure 4:
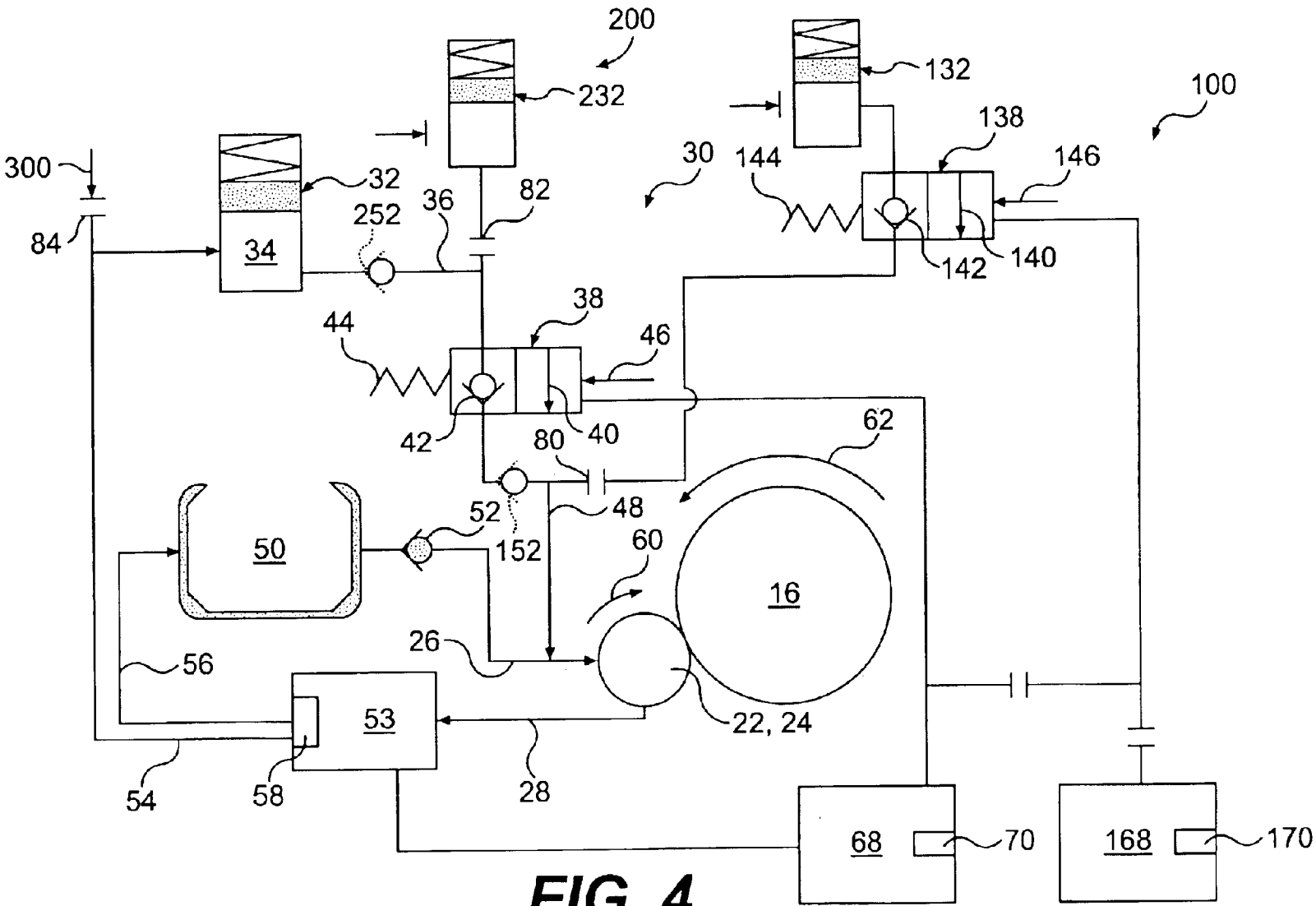
FIG. 4 is a schematic and diagrammatic illustration of a system for starting an internal combustion engine in accordance with another exemplary embodiment of the present invention.

As illustrated in FIG. 4, start system 30 may include a connector 80 that allows an external source of pressurized fluid to supply pressurized fluid to start system 30. Connector 80 may, for example, be placed between valve 38 and pump 22. Alternatively, a connector 82 may be placed between accumulator and valve 38 or a connector 84 may be placed between directional control valve 58 and accumulator 32. The external system may be housed in another vehicle or in a stand-alone charging/starting system.

A supplemental system 100 may be adapted to provide pressurized fluid to start system 30 through connector 80. Supplemental system 100 may include an external source of pressurized fluid, such as accumulator 132, and a valve 138. Valve 138, which may be a spool valve or any other type of controllable valve readily apparent to one skilled in the art, may control a flow of fluid from accumulator 132 to connector 80. Valve 138 may, for example, include an open passage 140 and a check valve 142. A spring 144 may act on valve 138 to move valve 138 so that check valve 142 is aligned with a fluid line leading to accumulator 132. Check valve 142 will prevent fluid from flowing through valve 138. To open valve 138, a force 146 may be applied to valve 138. Force 146 moves open passage 140 into alignment with accumulator 132 to allow fluid to flow from accumulator to connector 80. A check valve 152 may be placed between connector 80 and valve 38 to prevent an undesirable flow of fluid from flowing through valve 38.

Supplemental system 100 may provide fluid to start system 30 to invoke a rotation of crankshaft 12 to start engine 10. Supplemental system 100 may be connected to start system 30 to jump start a vehicle. Supplemental system 100 may include a separate control 168 having a memory 170 to control the position of valve 138. Alternatively, control 68 of start system 30 may be used to control the position of valve 138.

In another embodiment, a supplemental system 200 may be used to provide pressurized fluid through connector 82. Supplemental system 200 may include an external source of pressurized fluid, such as accumulator 232. The flow of fluid from accumulator 232 may be controlled by valve 38 of start system 30. A check valve 252 may be positioned between connector 82 and accumulator 32 to prevent fluid from flowing into accumulator 32. Supplemental system 200 may also be used to jump start a vehicle.

Alternatively, an external source of pressurized fluid 300 may be connected to start system 30 through connector 84. External source of pressurized fluid 300 may be connected to provide a flow of pressurized fluid to accumulator 34. If, for example, the supply of pressurized fluid in accumulator 32 is depleted so that engine 10 cannot be started, external source of pressurized fluid 300 may be connected to start system 30 to supply additional pressurized fluid to accumulator 32 so that engine 10 may be started.

INDUSTRIAL APPLICABILITY

As will be apparent from the foregoing description, the present invention provides a hydraulically powered start system for an engine. Energy generated during the ordinary operation of the vehicle may be stored as pressurized fluid in an accumulator. After the engine has been stopped, the stored pressurized fluid may be released from the accumulator. The fluid released from the accumulator may drive a pump and induce a rotation of the crankshaft of the engine. The induced rotation of the crankshaft may cause the engine to start. Once the engine is operating, the engine may be used to drive the pump and generate additional pressurized fluid. Thus, the present invention allows energy to be captured as pressurized fluid and later used to start or to assist in the start of the engine.

The present invention may be implemented into any vehicle that includes an engine having a crankshaft. The start system of the present invention may be used to replace or supplement a conventional engine start system. A vehicle that includes the present invention may not regularly use the conventional start system. Accordingly, the wear on the conventional start system may be reduced, resulting in less maintenance and repair time for the work machine. Moreover, the start system of the present invention may increase the overall efficiency of the vehicle.

It will be apparent to those skilled in the art that various modifications and variations can be made in the start system of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method of starting an engine having a crankshaft, comprising:

storing pressurized fluid in an accumulator;

releasing a flow of pressurized fluid from the accumulator;

modulating a single metering valve to control a flow rate of the pressurized fluid from the accumulator to the pump/motor based on a signal from a computer control;

directing the flow of pressurized fluid released from the accumulator to a pump/motor operatively engaged with the crankshaft of the engine; and driving the pump/motor with the flow of pressurized fluid to generate a rotation of the crankshaft and thereby start the engine.

2. The method of claim 1, further including closing the valve to prevent the flow of fluid from the accumulator to the pump/motor after the engine has started.

3. The method of claim 1, further including driving the pump/motor with the engine after the engine has started to generate a flow of pressurized fluid.

4. The method of claim 3, further including directing at least a portion of the flow of pressurized fluid generated by the pump/motor to the accumulator.

5. The method of claim 1, further including applying a torque to the crankshaft with a starter motor.

6. The method of claim 1, further including supplying pressurized fluid to the pump/motor from an external source of pressurized fluid.

7. A hydraulic circuit for starting an engine, comprising:

a pump/motor having a drive gear operatively engaged with the engine;

an accumulator in fluid communication with the pump/motor and configured to store a supply of pressurized fluid;

a single metering valve configured to allow a flow of pressurized fluid to flow from the accumulator to the pump/motor; and a computer control configured to provide a signal to selectively open the valve to allow the flow of pressurized fluid from the accumulator to the pump/motor to drive the pump/motor and thereby start the engine and to control a flow rate of the pressurized fluid from the accumulator to the pump/motor.

8. The hydraulic circuit of claim 7, wherein the pump/motor is configured to generate a second flow of pressurized fluid when the engine is operating.

9. The hydraulic circuit of claim 8, wherein the accumulator is configured to store at least a portion of the second flow of pressurized fluid generated by the pump/motor.

10. The hydraulic circuit of claim 7, wherein the control is configured to close the valve after the engine has started.

11. The hydraulic circuit of claim 7, wherein the valve is an independent metering valve.

12. The hydraulic circuit of claim 7, wherein the pump/motor is a variable capacity pump/motor.

13. The hydraulic circuit of claim 7, further including a connector adapted to receive pressurized fluid from an external source of pressurized fluid.

14. The hydraulic circuit of claim 13, wherein the connector is disposed between the pump/motor and the valve.

15. The hydraulic circuit of claim 13, wherein the connector is disposed between the accumulator and the valve.

16. An engine system, comprising:

an engine having a crankshaft operatively connected to at least one piston;

a pump/motor operatively engaged with the crankshaft of the engine;

an accumulator in fluid connection with the pump/motor, the accumulator configured to store a supply of pressurized fluid from the pump/motor and to provide a flow of pressurized fluid to the pump/motor to drive the pump and rotate the crankshaft to thereby start the engine; and a single metering valve configured to be modulated to control a flow rate of the pressurized fluid from the accumulator to the pump/motor based on a signal from a computer control.

17. The engine system of claim 16, wherein the engine includes a flywheel securably fixed to the crankshaft and operatively engaged with the pump/motor.

18. The engine system of claim 17, wherein the pump/motor includes a drive gear operatively engaged with the engine flywheel.

19. The engine system of claim 16, wherein the engine is an internal combustion engine.

20. The engine system of claim 16, further including a starter motor operatively engaged with the crankshaft.

21. The engine system of claim 16, wherein the pump/motor is a fixed capacity pump/motor.

22. An engine system, comprising:

an engine having a crankshaft operatively connected to at least one piston;

a pump/motor operatively engaged with the crankshaft of the engine;

an accumulator in fluid connection with the pump/motor, the accumulator configured to store a supply of pressurized fluid;

a single metering valve disposed between the pump and the accumulator to allow a flow of pressurized fluid from the accumulator to the pump/motor; and a computer control configured to provide a signal to selectively open the valve to allow the flow of pressurized fluid from the accumulator to the pump/motor to drive the pump/motor and rotate the crankshaft of the engine to thereby start the engine and to control a flow rate of the pressurized fluid from the accumulator to the pump/motor.

* * * * *